US011186094B2

(12) United States Patent
Fernández Vázquez et al.

(10) Patent No.: US 11,186,094 B2
(45) Date of Patent: Nov. 30, 2021

(54) RECIRCULATION SYSTEM FOR RECIRCULATING PRINT HEADS

(71) Applicant: TECGLASS SL, Lalin (ES)

(72) Inventors: Juan Javier Fernández Vázquez, Lalin (ES); José Manuel Barros López, Lalin (ES)

(73) Assignee: TECGLASS SL, Lalin (ES)

( * ) Notice: Subject to any disclaimer, the term of this patent is extended or adjusted under 35 U.S.C. 154(b) by 0 days.

(21) Appl. No.: 16/652,402

(22) PCT Filed: Sep. 25, 2018

(86) PCT No.: PCT/ES2018/070616

§ 371 (c)(1),
(2) Date: Mar. 30, 2020

(87) PCT Pub. No.: WO2019/058014

PCT Pub. Date: Mar. 28, 2019

(65) Prior Publication Data

US 2020/0282739 A1 Sep. 10, 2020

(30) Foreign Application Priority Data

Sep. 29, 2017 (ES) ..... ES201731165

(51) Int. Cl.
*B41J 2/18* (2006.01)

(52) U.S. Cl.
CPC ..... *B41J 2/18* (2013.01)

(58) Field of Classification Search
CPC ..... B41J 2/18
See application file for complete search history.

(56) References Cited

U.S. PATENT DOCUMENTS

| | | | | |
|---|---|---|---|---|
| 4,929,963 | A | 5/1990 | Balazar | |
| 2010/0079559 | A1 | 4/2010 | Justice et al. | |
| 2012/0147105 | A1* | 6/2012 | Jones | B41J 2/17593 347/88 |
| 2013/0063528 | A1 | 3/2013 | Govyadinov et al. | |
| 2014/0240406 | A1* | 8/2014 | LaCaze | B41J 2/175 347/85 |

FOREIGN PATENT DOCUMENTS

EP 1359027 A2 11/2003

OTHER PUBLICATIONS

Spanish Patent and Trademark Office, "International Search Report" in connection with related International Application No. PCT/ES2018/070616, dated Dec. 14, 2018, 4 pgs.

* cited by examiner

*Primary Examiner* — Jason S Uhlenhake
(74) *Attorney, Agent, or Firm* — Kolisch Hartwell, P.C.

(57) ABSTRACT

An ink recirculation system for recirculating printheads includes a housing with two chambers, a series of pressure sensors, a vacuum generator and a pressure generator The container has two entrances for transmitting signals towards the pressure sensors, a first feed connection to the printhead, a second flow connection to the printhead, a third ink feed connection, a fourth connection for returning the ink to the main tank and means for connecting and supporting the vacuum generator and the pressure generator.

5 Claims, 1 Drawing Sheet

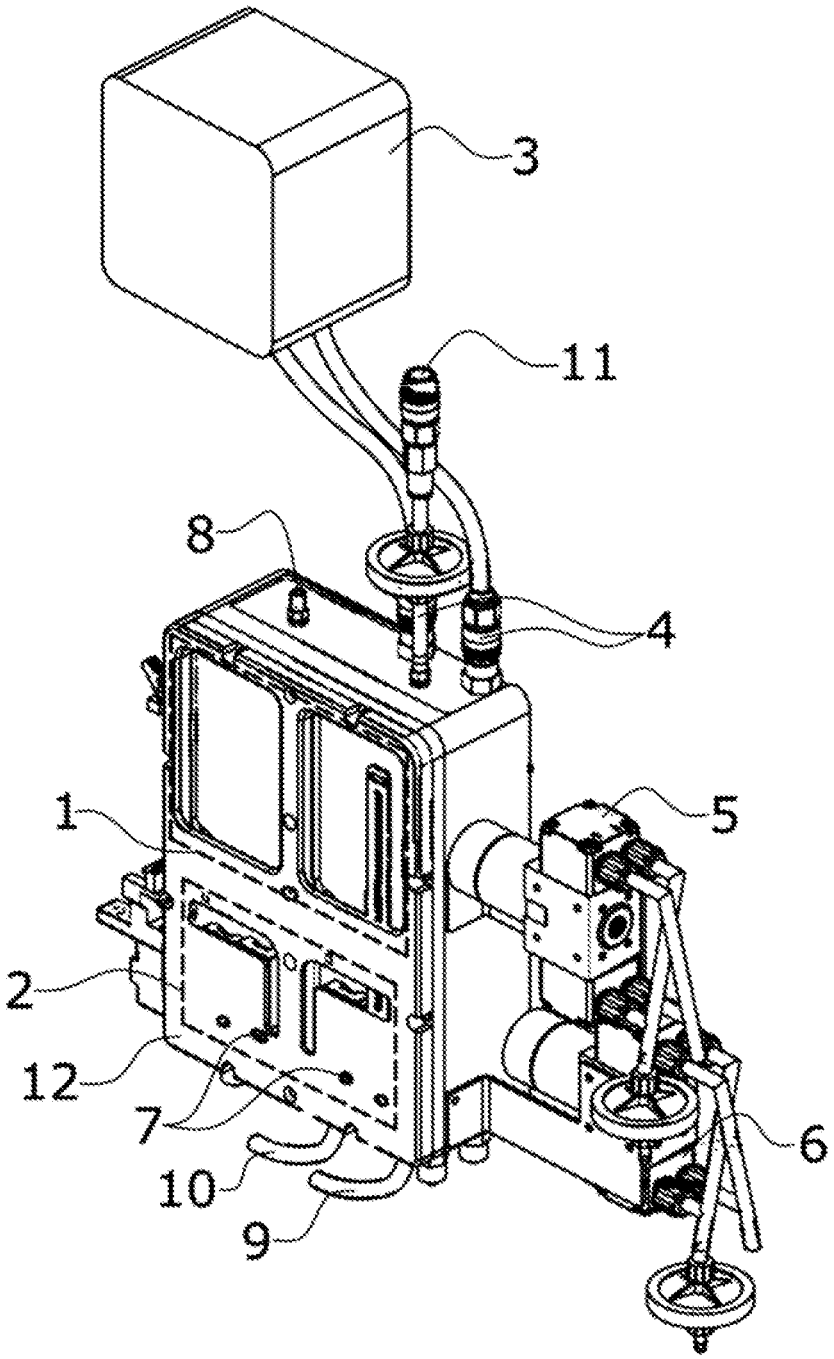
3
11
8
4
1
5
2
12
7
6
10
9

RECIRCULATION SYSTEM FOR RECIRCULATING PRINT HEADS

OBJECT OF THE INVENTION

The object of the present invention, as established in the title, is a recirculation system for recirculating printheads, i.e. it relates to a system for recirculating ink in inkjet printheads.

The present invention is characterised by the special configuration and design of each of the elements that form part of the system such that, arranged together, a compact assembly is obtained that occupies very little space, wherein it is possible to maintain a very constant flow and in a single direction, easy to assemble and disassemble, that makes it possible to feed a large number of printheads, in addition to enabling the exact control of temperature.

Therefore, the present invention falls within the field of ink printing systems.

BACKGROUND OF THE INVENTION

In the state of the art of printing systems there is a need, among other functionalities, to easily interchange the printing systems. This is especially the case in the glass sector, since many specific colours are used (such as premixed RAL colours) that cannot be obtained from mixing the six basic colours, and therefore this ink recirculation system must be easily interchangeable to feed the printhead with different ink colours as required.

It is also necessary to clean the tank, which should be a simple task because, on requiring constant changes in colour while a recirculation system is working, another system may be outside the machine being prepared with another colour. Additionally, the printheads, when manufactured and although subjected to very strict quality controls, may always have small differences and in such precise work as that performed by them, it is also very difficult to maintain a very constant flow and in a single direction.

In the state of the art, the recirculation system described in U.S. Pat. No. 8,926,077B1 is known, which has a series of limitations such as those described below:

- It is not manufactured in a compact manner, such that it can be mounted in an easily interchangeable manner to make colour changes in the printhead that is printing.
- It has an ink level control in contact with the ink, which makes cleaning the tank very complex.
- It does not have a control system that makes it possible to maintain a constant flow.

The recirculation system described in patent EP2875956 A1 is known which, while having a recirculation system, the means used for such purpose are complex. In particular, it only has suction means, due to which the use of tanks inserted between a first container and a second container and the suction means is required, to which end it must be connected to a distribution valve and safety means. Furthermore, the recirculation system has level indicator sensors installed inside the chambers themselves, which requires continuous maintenance and false measurements.

Therefore, the system described in said patent EP2875956 A1 is complex, not compact, and is difficult to interchange with another, especially when multiple colours must be used, and cannot be mounted on carriages that move at high speeds greater than 2 m/s and acceleration/deceleration greater than 2 m/s2. It also has temperature control problems due to the long tube lengths and the large ink volumes it must use.

Consequently, the object of the present invention is to develop a recirculation system for printheads that is compact, can be easily interchanged for another, can be used in carriages with speeds greater than 2 m/s, avoids false measurements and continuous maintenance, and also enables exact temperature control by developing a system such as that described below and is included in its essentiality in claim one.

DESCRIPTION OF THE INVENTION

The object of the present invention is a system for recirculating ink for recirculating printheads comprising a housing in the manner of a casing or container in whose interior there are two chambers, a first chamber and a second chamber, a series of pressure sensors, a vacuum generator and a pressure generator.

The housing or container where the chambers are housed has two entrances for transmitting signals towards the pressure sensors, a first feed connection to the printhead, a second return connection for the printhead, a third ink feed connection, a fourth connection for returning the ink to the main tank and means for connecting and supporting the vacuum generator and pressure generator, both being preferably actuated by means of corresponding pumps.

At the same time, it has two pumps for interchanging the fluid from one chamber to another in accordance with the pressures applied.

Each of the tanks complementarily has a breakwater design that prevents turbulences of the liquid when moving at high speeds and suffering accelerations, making it possible to maintain a constant flow.

In a complementary embodiment within the outer casing or container, the tank comprised in the chamber would be removable in order to be replaced by another, with the object of facilitating the change in paint and avoiding having to clean the tanks in depth.

The system also has means for controlling the temperature of the fluid, since the system, on being compact and handling small amounts of ink in the chambers, avoids drops in temperature due to the long tube lengths and large volumes in the chambers.

In a possible form of embodiment, the temperature control means comprise an external heating blanket that embraces and envelopes the outer casing or container; additionally, the connection tubes to and from the printhead are sheathed in a sleeve that keeps ink temperature under control, which is of particular relevance when using thermoplastic inks (TPS).

Since the housing has the described features, a compact assembly is achieved that occupies little space and that allows it to be mounted on a moving printing carriage, thereby enabling various recirculation systems for feeding several colours. It is easily and quickly mounted, making it possible to interchange recirculation systems and make quick changes in colour.

It is also possible to maintain a constant flow and in a single direction, since it is essential to maintain a constant flow and print in the direction of flow indicated by the manufacturer. It is also possible to feed a large number of printheads as a result of the compactness of the complete system.

Due to its design, this system is especially developed to recirculate inkjet inks with a high solid content >40%. These types of inks are especially difficult to recirculate due to the large amount of suspended solid particles.

Unless otherwise indicated, all the technical and scientific elements used in this report have the meaning usually understood by a person skilled in the art to which this invention belongs. In the practice of this invention, procedures and materials similar or equivalent to those described in the report can be used.

In the description and claims, the word "comprise" and its variants do not aim to exclude other technical characteristics, additives, components or steps. For persons skilled in the art, other objects, advantages and characteristics of the invention will be partly inferred from the description and partly from the practice of the invention.

DESCRIPTION OF THE FIGURES

In order to complement the description being made and with the aim of helping to better understand the characteristics of the invention, in accordance with a preferred example of a practical embodiment thereof, a set of drawings is provided as an integral part of said description wherein the following has been represented in an illustrative and non-limiting manner:

FIG. 1 shows a perspective view of the object of the invention wherein the different elements that form part of the system can be observed.

PREFERRED EMBODIMENT OF THE INVENTION

In light of the FIGURES, a preferred embodiment of the proposed invention is described below.

FIG. 1 shows a housing or casing or container (12) in whose interior a first chamber (1) and a second chamber (2) are disposed, not having a preferred location inside the housing.

The container (12) comprises a first feed connection (9) to the printhead and also has a second return connection (10) from the printhead. The upper part comprises a third connection (11) for feeding the ink and a fourth connection (8) for returning the ink to the main tank.

There are two entrances (4) defined on the container (12) wherethrough the signals pass to the pressure sensors (3).

The system has a vacuum generator (5) and a pressure generator (6), both mounted on a container (12) such that they are joined to the container (12), each of which comprise a pump for generating a vacuum or generating pressure.

Two bores (7) have been made in the container of the necessary size to allow the fixation and installation of external level sensors that prevent the sensors from coming into contact with the ink, thereby avoiding complex cleaning tasks.

The system has two pumps for interchanging the fluid from one chamber to another in accordance with the pressures applied.

When changing colour or performing maintenance, the tank needs to be cleaned in depth, an activity that requires a large amount of time; therefore and with the object of reducing times when there is a change in colour or cleaning must be performed, the tank that comprises the first (1) and second chambers (2) is removable from the casing or container (12).

The generators and sensors are screwed to the casing or container (12), which would house the disposable tank in its interior, to which the feed and connections of the pressure and vacuum generators are screwed, thereby avoiding having to perform cleaning.

Complementarily, the entire casing or container (12) would be enveloped in a thermal blanket that would act like a flexible sleeve that envelopes it and, at the same time, is an electrical resistor that maintains the temperature. This allows us to heat the tank to a temperature between 40° C. and 60° C., keeping it uniform.

The reason for seeking to maintain the temperature is to be able to use thermoplastic inks (TPS) in solid form and that it becomes fluid when the temperature increases.

The connection tubes to and from the printhead (9) and (10) are also sheathed in a sleeve that ensures that the ink is always at a very controlled temperature, since otherwise the ink would undergo substantial changes in viscosity because the ink is liquid at 60° C. but semi-solid at 40° C.

Having sufficiently described the nature of the present invention, in addition to the manner in which to put it into practice, it is hereby stated that, in its essence, it may be put into practice in other embodiments that differ in detail from that indicated by way of example, and to which the protection equally applies, provided that its main principle is not altered, changed or modified.

The invention claimed is:

1. A system for recirculating ink that flows through recirculating printheads, comprising:

a housing with a container (12) that defines an interior;

a first chamber (1) and a second chamber (2), each being housed in the interior of the container (12);

a series of pressure sensors connected to the container (12);

a vacuum generator (5) and a pressure generator (6) connected to the container (12); and wherein the container (12) is constructed with two entrances for transmitting signals towards the pressure sensors, a first printhead feed connection, a second return connection to the printhead, a third ink feed connection, a fourth connection for returning the ink to the main tank and means for connecting and supporting the vacuum generator and pressure generator; and wherein the container (12) houses a removable tank in communication with the feed, pressure and vacuum generator connections, wherein the removable tank is formed with an interior that includes first and second ink-storage chambers (1) and (2), and wherein the container also includes two pumps for interchanging the ink from one chamber to another in accordance with the applied pressure.

2. The ink recirculation system for recirculating printheads, according to claim 1, characterized in that each of the chambers, the first ink-storage chamber (1) and the second ink-storage chamber (2) have design that prevents turbulences of the liquid from moving at high speeds and becoming altered.

3. The ink recirculation system for recirculating printheads, according to claim 1, characterized in that the system also has means for controlling the temperature of the fluid.

4. The ink recirculation system for recirculating printheads, according to claim 3, characterized in that the temperature control means consist of a thermal blanket that envelopes the container (12) and maintains a temperature, and the connection tubes to and from the printhead (9) and (10) are sheathed in a sleeve that ensures the ink is at a controlled temperature.

5. The ink recirculation system for recirculating printheads, according to claim 4, characterized in that the vacuum generator and pressure generator are actuated by means of corresponding pumps.

* * * * *